US007719927B1

(12) United States Patent
Robinson et al.

(10) Patent No.: US 7,719,927 B1
(45) Date of Patent: May 18, 2010

(54) MEDICINE BOTTLE AND ASSOCIATED METHOD

(76) Inventors: E. Anthony Robinson, 12263 Knobhill La., Victorville, CA (US) 92392; Karan Robinson, 12263 Knobhill La., Victorville, CA (US) 92392

( * ) Notice: Subject to any disclaimer, the term of this patent is extended or adjusted under 35 U.S.C. 154(b) by 360 days.

(21) Appl. No.: 12/005,220

(22) Filed: Dec. 27, 2007

(51) Int. Cl.
*G04B 47/00* (2006.01)
*B65D 51/00* (2006.01)

(52) U.S. Cl. ..... 368/10; 215/230

(58) Field of Classification Search ..... 368/10; 215/201, 230, 306; 221/2, 3, 15
See application file for complete search history.

(56) References Cited

U.S. PATENT DOCUMENTS 4,419,016 A * 12/1983 Zoltan ..... 368/10
4,504,153 A * 3/1985 Schollmeyer et al. ..... 368/10
4,862,526 A 9/1989 Berger
4,939,705 A * 7/1990 Hamilton et al. ..... 368/10
4,993,006 A * 2/1991 Oshima et al. ..... 368/231
5,347,453 A * 9/1994 Maestre ..... 705/2
5,751,661 A * 5/1998 Walters ..... 368/10
5,805,051 A * 9/1998 Herrmann et al. ..... 340/309.4
5,835,455 A * 11/1998 Hanson et al. ..... 368/10
6,317,390 B1 * 11/2001 Cardoza ..... 368/10
6,324,123 B1 * 11/2001 Durso ..... 368/10
6,529,446 B1 3/2003 De La Huerga
6,633,796 B1 * 10/2003 Pool et al. ..... 700/231
6,710,703 B2 * 3/2004 Huang ..... 340/309.16
6,845,064 B2 1/2005 Hildebrandt

* cited by examiner

*Primary Examiner*—Vit W Miska

(57) ABSTRACT

A medicine bottle for reminding a patient to take a dosage of medicine at a prescribed time includes a disposable bottle and a corresponding disposable cap. The system further includes a mechanism for recording and playing back instructions to take the medicine dosage at the prescribed time and an amplifier electrically coupled directly to the audio recording and playback device, and a transducer electrically coupled to the amplifier. A mechanism is further included for selectively unlocking the lock actuator from a locked position when a present time is within a predetermined number of hours of the prescribed time.

18 Claims, 4 Drawing Sheets

MEDICINE BOTTLE AND ASSOCIATED METHOD

CROSS REFERENCE TO RELATED APPLICATIONS

This application claims the benefit of U.S. Provisional Application No. 60/872,570, filed Dec. 4, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to medicine bottles and, more particularly, to a medicine bottle for reminding a patient to take a dosage of medicine at a prescribed time.

2. Prior Art

The general purpose of an automated container is to improve patient compliance in taking the appropriate medication on schedule. While taking a particular medication on a regular schedule may seem a simple process, it is often difficult to accomplish, especially when the patient has been prescribed to take several medications. Dosing regimens that require the patient to take different doses of different medications at different times can be particularly confusing. Conventional medication containers designed for a patient's personal use on an out-patient basis do not assist the patient in taking the correct medication at the correct time, particularly when several medications have been prescribed. Based on the above mentioned needs, it would be advantageous to provide a means for assisting a user to verbally record intake instructions for medications.

U.S. Pat. No. 6,529,446 to de la Huerga discloses an interactive medication container or console that hold or otherwise organizes one or more medication vials or containers. Each vial has a memory strip containing medication and prescription information. Each vial can also include a reminder unit that is attached to and portable with the individual vials. The console or reminder unit reads the information strip of the vial and communicates this information to or interacts with a patient to remind them to take the medication. The medication container or reminder unit also gathers or tracks information such as consumption time, quantity remaining, patient feedback, and contraindication information. The medication container or reminder unit interacts with the patient by displaying questions or receiving and recording input from the patient before, during or after a dose of medication is taken. The patient input can be used to modify the dosing regimen for future doses of medication. The medication container reorders medication when the quantity remaining reaches a threshold level. Contraindication information in the memory strip is downloaded to a personal home computer or a hospital or nursing home computer.

Unfortunately, this prior art example is not designed to provide an audible reminder to tell a user to take their medication.

U.S. Pat. No. 6,845,064 to Hildebrandt discloses an improved device for timely medication administration that attaches to any original container cap and that measures and displays elapsed time in response to opening or closing of said original container cap is disclosed. Physical, chemical and labeled characteristics of the original medication vessel are thus preserved as dispensed. This device includes a timing unit, a compression reset switch and a thermoplastic housing for the above with a resilient, flexible, circumferential wall that permits operation of the enclosed compression reset switch. The thermoplastic housing also features a rigid lower lip that allows adhesive attachment to the original lid. Unfortunately, this prior art example is not designed to provide an audible reminder to tell a user to take their medication.

Accordingly, the present invention is discloses in order to overcome the above noted shortcomings. The present invention is convenient and easy to use, lightweight yet durable in design, and designed for reminding a patient to take a dosage of medicine at a prescribed time. The medicine bottle is simple to use, inexpensive, and designed for many years of repeated use.

BRIEF SUMMARY OF THE INVENTION

In view of the foregoing background, it is therefore an object of the present invention to provide an apparatus for reminding a patient to take a dosage of medicine at a prescribed time. These and other objects, features, and advantages of the invention are provided by a medicine bottle.

A medicine bottle for reminding a patient to take a dosage of medicine at a prescribed time includes a disposable bottle and a corresponding disposable cap permanently conjoined to the bottle in such a manner that the cap is selectively adaptable between open and closed positions with respect to the bottle while being prohibited from being displaced more than a maximum distance from the bottle so that the cap is not lost during open positions. Such a cap has a lock actuator attached thereto and the bottle respectively, and includes a flexible strap with opposed ends permanently connected to a bottom edge of the cap and a top edge of the bottle so that the cap is effectively prohibited from being permanently misplaced. The cap is further provided with a plurality of orifices formed along a top surface thereof for allowing an audio signal to emanate outwardly from a transducer and the cap respectively.

The system further includes a mechanism for recording and playing back instructions to take the medicine dosage at the prescribed time. Such a recording and playback mechanism includes an internal power source housed within the cap and an audio recording and playback device electrically coupled to the power source and mated to the cap respectively. The mechanism further includes an amplifier electrically coupled directly to the audio recording and playback device, and a transducer electrically coupled to the amplifier. The amplifier and the transducer are conveniently housed within the cap.

The system further includes a mechanism for selectively unlocking the lock actuator from a locked position when a present time is within a predetermined number of hours of the prescribed time. Such a selectively unlocking mechanism includes a logic gate housed within the cap and a timer electrically coupled to the user interface and the audio recording and playback device. Such a timer generates a time signal at a preprogrammed interval set by a pharmacist, and the logic gate generates and transmits a true output control signal to the lock actuator upon receiving the audio signal and the time signal within a predetermined time interval. The logic gate further advantageously generates and transmits a false output control signal when the time signal is not received within the predetermined time interval after receiving the audio signal, and the true output signal adapts the lock actuator to an unlocked position.

The system further includes a mechanism for effectively notifying the patient when a remaining quantity of the medicine has fallen below a minimum threshold quantity and a final one of the prescribed time has not occurred. Such a patient notifying mechanism includes a counter electrically coupled to the logic gate and an alarm electrically coupled to the timer. The pharmacists set the counter at an initial numerical value equal to an initial quantity of the medicine deposited within the bottle, and the logic gate further transmits the true logic output signal to the counter. The counter subtracts one unit value from the initial numerical value each time one of the true output control signals are received from the logic gate, and the counter generates and transmits an alarm signal to the alarm when the initial quantity of medicine drops below a minimum threshold level such that a user is notified when a remaining quantity of medicine is approaching zero.

The system further includes a user interface conveniently displayed on the cap and electrically mated to the recording and playback mechanism, the selectively unlocking mechanism, and the patient notifying mechanism respectively.

A method for reminding a patient to take a dosage of medicine at a prescribed time includes the steps of: providing a disposable bottle; providing a corresponding disposable cap permanently conjoined to the bottle in such a manner that the cap is selectively adaptable between open and closed positions with respect to the bottle while being prohibited from being displaced more than a maximum distance from the bottle so that the cap is not lost during open positions; selectively recording and playing back instructions to take the medicine dosage at the prescribed time; selectively unlocking the lock actuator from a locked position when a present time is within a predetermined number of hours of the prescribed time; and notifying the patient when a remaining quantity of the medicine has fallen below a minimum threshold quantity and a final one of the prescribed time has not occurred.

The method further includes the steps of: providing an internal power source housed within the cap; and providing an audio recording and playback device electrically coupled to the power source and mated to the cap respectively; providing an amplifier electrically coupled directly to the audio recording and playback device; and providing a transducer electrically coupled to the amplifier, the amplifier and the transducer being housed within the cap.

The method further includes the steps of: providing a logic gate housed within the cap; providing a timer electrically coupled to the user interface and the audio recording and playback device; the timer generating a time signal at a preprogrammed interval set by a pharmacist; the logic gate generating and transmitting a true output control signal to the lock actuator upon receiving the audio signal and the time signal within a predetermined time interval to thereby adapt the lock actuator to an unlocked position; and the logic gate generating and transmitting a false output control signal when the time signal is not received within the predetermined time interval after receiving the audio signal.

The method further includes the steps of: providing a counter electrically coupled to the logic gate; providing an alarm electrically coupled to the timer; a pharmacist setting the counter at an initial numerical value equal to an initial quantity of the medicine deposited within the bottle; the logic gate transmitting the true logic output signal to the counter; the counter subtracting one unit value from the initial numerical value each time one of the true output control signals are received from the logic gate; and the counter generating and transmitting an alarm signal to the alarm when the initial quantity of medicine drops below a minimum threshold level such that a user is notified when a remaining quantity of medicine is approaching zero.

The method further includes the step of: providing a flexible strap with opposed ends permanently connected to a bottom edge of the cap and a top edge of the bottle so that the cap is prohibited from is permanently misplaced; and forming a plurality of orifices within the cap for allowing an audio signal to emanate outwardly from the transducer and the cap respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
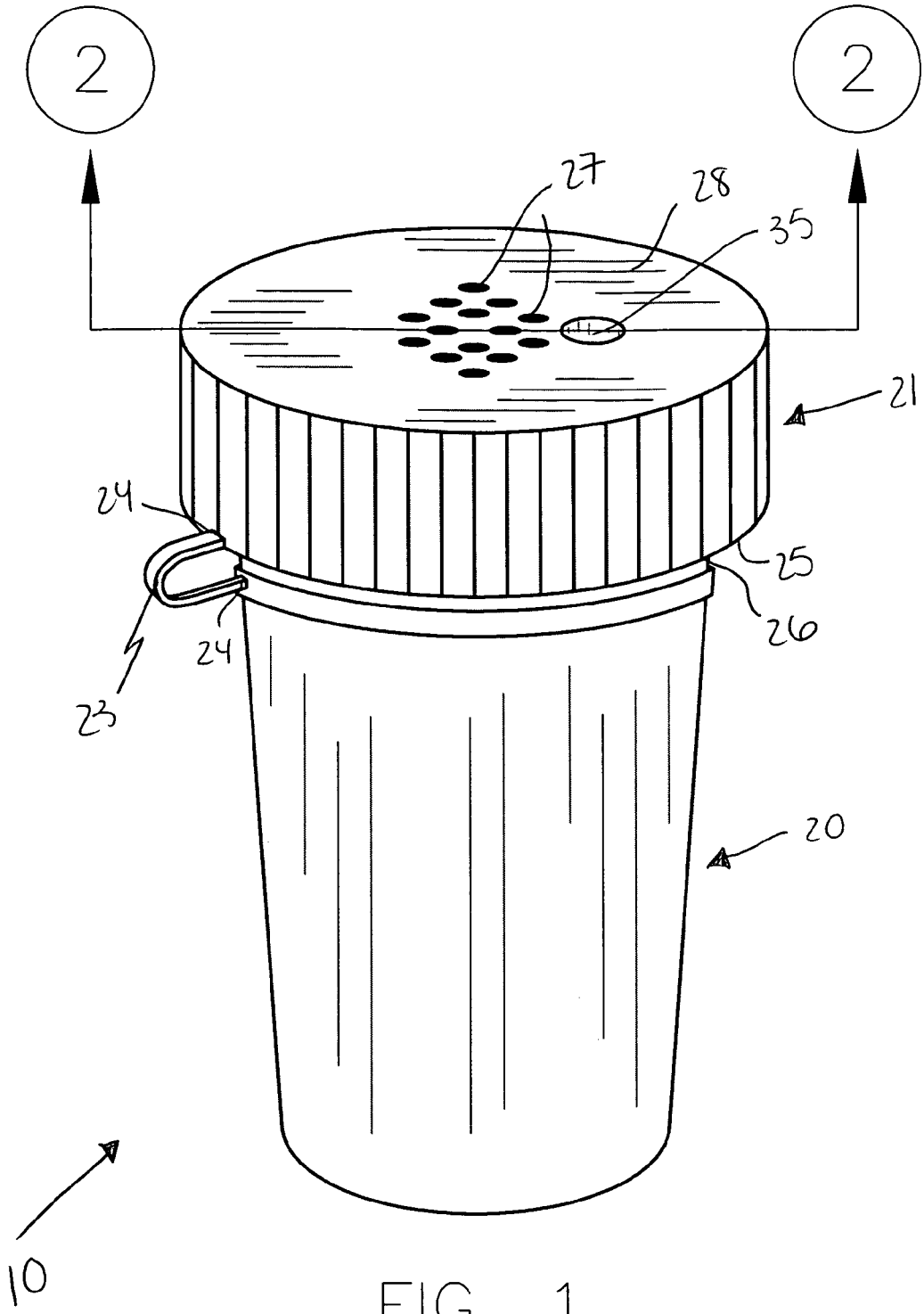
FIG. 1 is perspective view of a medicine bottle, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to protect a medicine bottle for reminding a patient to take a dosage of medicine at a prescribed time. It should be understood that the apparatus 10 may be used to protect many different types of bottles and should not be limited in use with only those types of bottles mentioned herein.

Referring initially to FIGS. 1, 2, 3 and 4, a medicine bottle 10 for reminding a patient to take a dosage of medicine at a prescribed time includes a disposable bottle 20 and a corresponding disposable cap 21 permanently conjoined to the bottle 20 in such a manner that the cap 21 is selectively adaptable between open and closed positions with respect to the bottle 20 while being prohibited from being displaced more than a maximum distance from the bottle 20 so that the cap 21 is not lost during open positions. Such a cap 21 has a lock actuator 22 attached thereto and the bottle 20 respectively, and includes a flexible strap 23 with opposed ends 24 permanently connected to a bottom edge 25 of the cap 21 and a top edge 26 of the bottle 20 so that the cap 21 is prohibited from being permanently misplaced. The cap 21 is further provided with a plurality of orifices 27 formed along a top surface 28 thereof for allowing an audio signal to emanate outwardly from a transducer 29 and the cap 21 respectively. The bottle and cap 20, 21 are used to house standard prescription pills or capsules.

Figure 4:
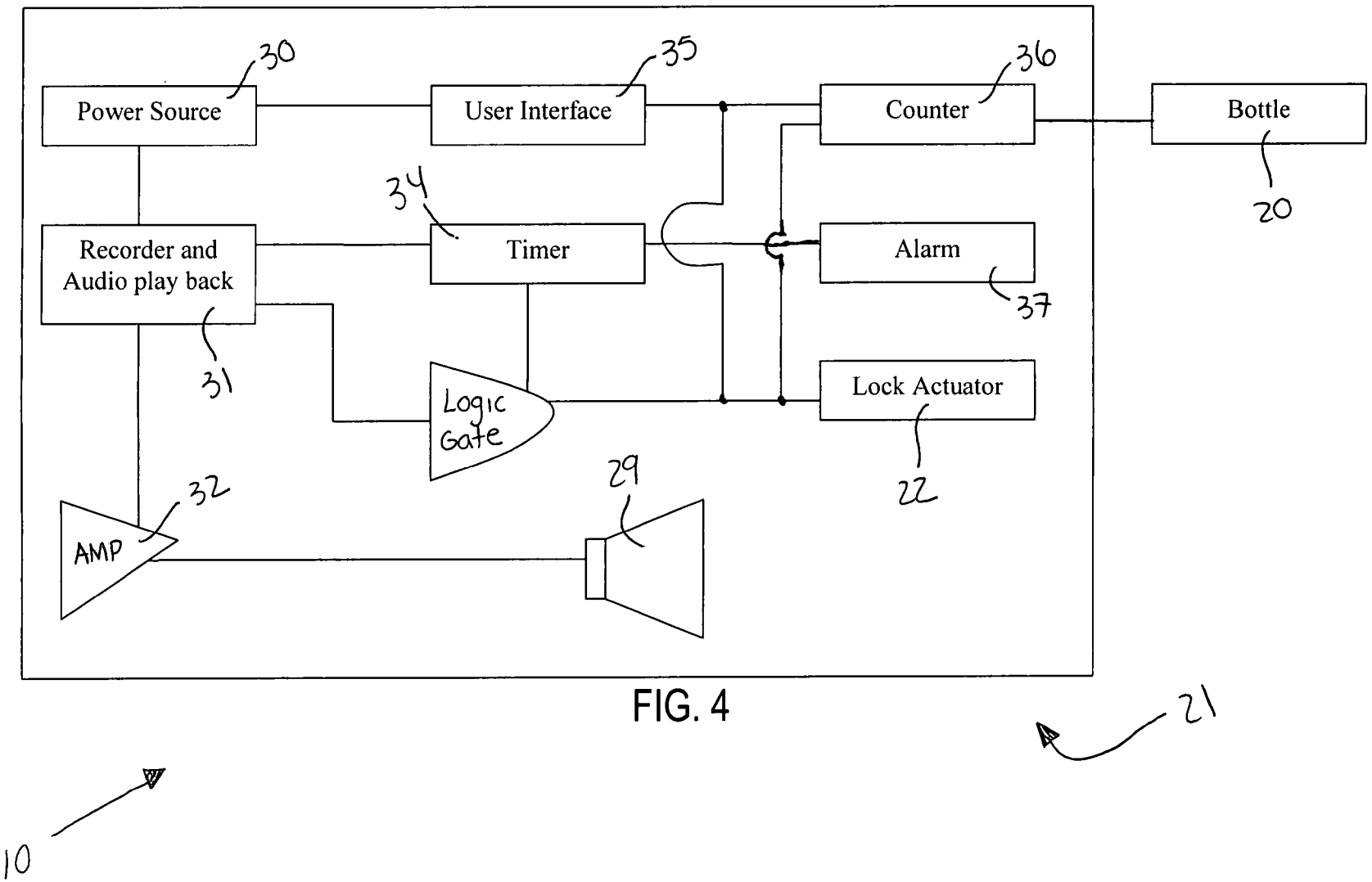
FIG. 4 is schematic block diagram of a medicine bottle, in accordance with the present invention.

Referring to FIG. 4, the system further includes a mechanism for recording and playing back instructions to take the medicine dosage at the prescribed time. Such a recording and playback mechanism includes an internal power source 30 housed within the cap 21 and an audio recording and playback device 31 electrically coupled to the power source 30 and mated to the cap 21 respectively. The mechanism further includes an amplifier 32 electrically coupled directly, without the use of intervening elements, to the audio recording and playback device 31, and a transducer 29 electrically coupled to the amplifier 32. The amplifier 32 and the transducer 29 are housed within the cap 21. The recording and playback mechanism is designed for recording a message according to the directions of a prescription. Then, a user can play back the message in order to determine how a prescription should be imbibed.

Referring again to FIG. 4, the system further includes a mechanism for selectively unlocking the lock actuator 22 from a locked position when a present time is within a predetermined number of hours of the prescribed time. Such a selectively unlocking mechanism includes a logic gate 33 housed within the cap 21 and a timer 34 electrically coupled to the user interface 35 and the audio recording and playback device 32. Such a timer 34 generates a time signal at a preprogrammed interval set by a pharmacist, and the logic gate 33 generates and transmits a true output control signal to the lock actuator 22 upon receiving the audio signal and the time signal within a predetermined time interval. The logic gate 33 further generates and transmits a false output control signal when the time signal is not received within the predetermined time interval after receiving the audio signal, and the true output signal adapts the lock actuator 22 to an unlocked position. The selectively locking mechanism automatically unlocks the container when a predetermined amount of time has passed, thereby allowing a user to access their medication.

Referring again to FIG. 4, the system further includes a mechanism for notifying the patient when a remaining quantity of the medicine has fallen below a minimum threshold quantity and a final one of the prescribed time has not occurred. Such a patient notifying mechanism includes a counter 36 electrically coupled to the logic gate 33 and an alarm 37 electrically coupled to the timer 34. The pharmacists set the counter 36 at an initial numerical value equal to an initial quantity of the medicine deposited within the bottle 20, and the logic gate 33 further transmits the true logic output signal to the counter 36. The counter 36 subtracts one unit value from the initial numerical value each time one of the true output control signals are received from the logic gate 33, and the counter 36 generates and transmits an alarm signal to the alarm 37 when the initial quantity of medicine drops below a minimum threshold level which is essential such that a user is notified when a remaining quantity of medicine is approaching zero. The notifying mechanism notifies a user that their medication is running low, thereby enabling the user to arrange a refill, if needed.

Figure 2:
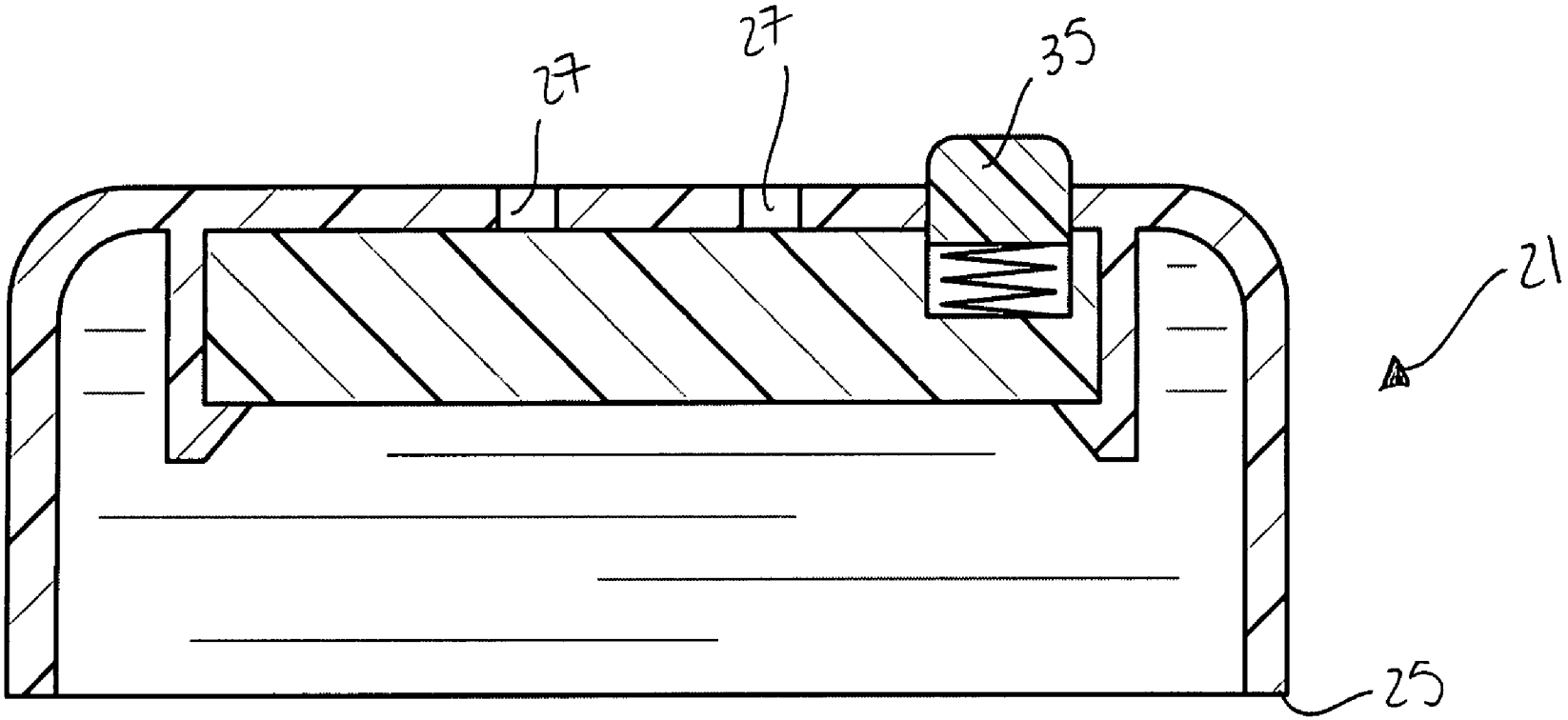
FIG. 2 is a cross sectional view, taken along line 2-2, as seen in FIG. 1.
Figure 3:
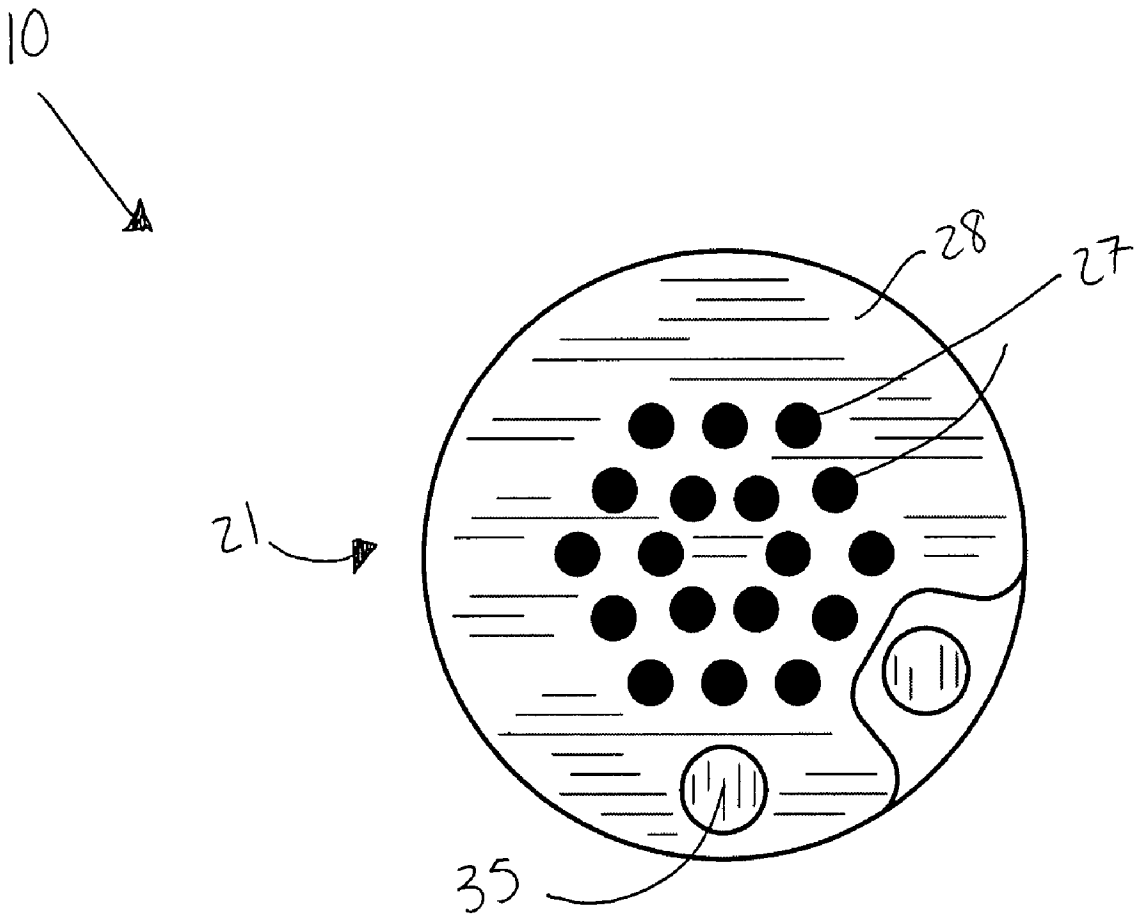
FIG. 3 is a top planar view of a medicine bottle, in accordance with the present invention.

Referring to FIGS. 2 and 4, the system further includes a user interface 35 displayed on the cap 21 and electrically mated to the recording and playback mechanism, the selectively unlocking mechanism, and the patient notifying mechanism respectively. The user interface 35 is provided for allowing a user to play back the recorded directions whenever needed.

The system includes a specially designed bottle and cap system that incorporates an electronic tracking device for advantageously recording and playing back intake instructions of medications. Such a system includes a standard prescription medication bottle, albeit with a plethora of enhancements. First, the cap is hinge mounted onto the bottle, as this is an essential component of the unit's circuitry. Internally contained within this device's durable plastic housing is the required electronic circuitry for operation, as well as a sophisticated computer chip in the cap itself, which is critical for recording medication data such as the name of a drug, number of pills taken, and dosage times of day for that particular medication regimen. Of course, such a bottle and cap can be formed from a variety of suitable materials and produced in a variety of shapes and sizes, as is obvious to a person of ordinary skill in the art.

An additional interior component of the system is a smaller speaker, which is vital to provide an audible reminder at the times medications need to be taken. In addition, the system is advantageously equipped with an internal alarm that also serves as an audible reminder, as well as a counter that ticks off the number of pills taken according to the number of times the bottle is opened. The system is powered by a battery source such as the micro-alkaline or silver oxide cell batteries commonly found in wristwatches, as examples. Of course, such a system can be powered by a variety of suitable power sources, as is obvious to a person of ordinary skill in the art. The cap of the system lights up for use by individuals who are hearing impaired.

In use, the electronic medication bottle and cap system is simple and straightforward to use. First, the user gathers all medications currently being taken. Next, following package instructions, the user (in this case, the pharmacist) voice-inputs all pertinent information from each medication label into the system database. By way of example, for a sufferer of strep throat, the pharmacist records "Penicillin," to be taken as "1 tablet 4 times daily". Reminder times for dosages are then set, such as "9 A.M., 1 P.M., 5 P.M., 9 P.M." Information is inputted into the device in a similar fashion for any other medications that are being taken. Again following instructions, the pharmacist then disables the recording feature, leaving playback available.

Some of the bottles come prerecorded in order to save the pharmacist time. All the pharmacists need to say is, "This prescription is for John Doe," and the rest of the information is already prerecorded. Now operational, the system emits an audible beeping sound at 9:00 AM to remind the recipient that a penicillin pill is to be taken. To be sure they have the right bottle the user presses the Playback button to determine the medication. Removing the pill from the bottle and completing the dosage, the user disables the alarm while enabling the system to count off that particular dosage. The system operates in a similar manner for all other medications, whether blood pressure pills, arthritis tablets, antibiotics, or even liquid medications, as examples.

The present invention, as claimed, provides the unexpected and unpredictable benefit of a system that is convenient and easy to use, is lightweight yet durable in design, and provides consumers with an electronic, efficient means of keeping track of medication information and dosage instructions. Eliminating the confusion often associated with taking multiple medications, the system effectively organizes each medicine and its directives in its cleverly configured database. Especially beneficial to elderly patients with multiple prescriptions and parents with sick children, the present invention provides an audible reminder of when and how much of a certain medicine is to be taken. Additionally, the database conveniently indicates that dosage instructions have been followed and completed. In this manner, users will not mistakenly miss a dose, or worse, take more than is needed. The system effectively eliminates the need to guess at hard-to-read instructions or to rely on others to read labels. The playback feature advantageously renders dosage instructions unmistakable for those who have difficulty seeing.

In use, a method for reminding a patient to take a dosage of medicine at a prescribed time includes the steps of: providing a disposable bottle 20; providing a corresponding disposable cap 21 permanently conjoined to the bottle 20 in such a manner that the cap 21 is selectively adaptable between open and closed positions with respect to the bottle 20 while being prohibited from being displaced more than a maximum distance from the bottle 20 so that the cap 21 is not lost during open positions; selectively recording and playing back instructions to take the medicine dosage at the prescribed time; selectively unlocking the lock actuator 22 from a locked position when a present time is within a predetermined number of hours of the prescribed time; and notifying the patient when a remaining quantity of the medicine has fallen below a minimum threshold quantity and a final one of the prescribed time has not occurred.

In use, the method further includes the steps of: providing an internal power source 30 housed within the cap 21; and providing an audio recording and playback device 31 electrically coupled to the power source 30 and mated to the cap 21 respectively; providing an amplifier 32 electrically coupled directly, without the use of intervening elements, to the audio recording and playback device 31; and providing a transducer 29 electrically coupled to the amplifier 32, the amplifier 32 and the transducer 29 being housed within the cap 21.

In use, the method further includes the steps of: providing a logic gate 33 housed within the cap 21; providing a timer 34 electrically coupled to the user interface 35 and the audio recording and playback device 31; the timer 34 generating a time signal at a preprogrammed interval set by a pharmacist; the logic gate 33 generating and transmitting a true output control signal to the lock actuator 22 upon receiving the audio signal and the time signal within a predetermined time interval to thereby adapt the lock actuator 22 to an unlocked position; and the logic gate 33 generating and transmitting a false output control signal when the time signal is not received within the predetermined time interval after receiving the audio signal.

In use, the method further includes the steps of: providing a counter electrically coupled to the logic gate 33; providing an alarm 27 electrically coupled to the timer 34; a pharmacist setting the counter at an initial numerical value equal to an initial quantity of the medicine deposited within the bottle 20; the logic gate 33 transmitting the true logic output signal to the counter 36; the counter 36 subtracting one unit value from the initial numerical value each time one of the true output control signals are received from the logic gate 33; and the counter 36 generating and transmitting an alarm signal to the alarm 27 when the initial quantity of medicine drops below a minimum threshold level such that a user is notified when a remaining quantity of medicine is approaching zero.

In use, the method further includes the step of: providing a flexible strap 23 with opposed ends 24 permanently connected to a bottom edge 25 of the cap 21 and a top edge 26 of the bottle 20 so that the cap 21 is prohibited from is permanently misplaced; and forming a plurality of orifices 27 within the cap 21 for allowing an audio signal to emanate outwardly from the transducer 29 and the cap respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A medicine bottle for reminding a patient to take a dosage of medicine at a prescribed time, said medicine bottle comprising:

a bottle;

a corresponding cap permanently conjoined to said bottle in such a manner that said cap is selectively adaptable between open and closed positions with respect to said bottle while being prohibited from being displaced more than a maximum distance from said bottle so that said cap is not lost during open positions, said cap having a lock actuator attached thereto and said bottle respectively;

means for recording and playing back instructions to take the medicine dosage at the prescribed time;

means for selectively unlocking said lock actuator from a locked position when a present time is within a predetermined number of hours of the prescribed time;

means for notifying the patient when a remaining quantity of the medicine has fallen below a minimum threshold quantity and a final one of the prescribed time has not occurred; and a user interface electrically mated to said recording and playback means, said selectively unlocking means, and said patient notifying means respectively.

2. The medicine bottle of claim 1, wherein said recording and playback means comprises:

an internal power source housed within said cap; and an audio recording and playback device electrically coupled to said power source and mated to said cap respectively;

an amplifier electrically coupled directly to said audio recording and playback device; and a transducer electrically coupled to said amplifier, said amplifier and said transducer being housed within said cap.

3. The medicine bottle of claim 2, wherein said selectively unlocking means comprises:

a logic gate housed within said cap;

a timer electrically coupled to said user interface and said audio recording and playback device, said timer generating a time signal at a preprogrammed interval set by a pharmacist; and wherein said logic gate generates and transmits a true output control signal to said lock actuator upon receiving said audio signal and said time signal within a predetermined time interval;

wherein said logic gate generates and transmits a false output control signal when said time signal is not received within the predetermined time interval after receiving said audio signal;

wherein said true output signal adapts said lock actuator to an unlocked position.

4. The medicine bottle of claim 3, wherein said patient notifying means comprises:

a counter electrically coupled to said logic gate; and an alarm electrically coupled to said timer;

wherein the pharmacists sets said counter at an initial numerical value equal to an initial quantity of the medicine deposited within said bottle, said logic gate further transmitting said true logic output signal to said counter;

wherein said counter subtracts one unit value from the initial numerical value each time one of said true output control signals are received from said logic gate, said counter generating and transmitting an alarm signal to said alarm when the initial quantity of medicine drops below a minimum threshold level such that a user is notified when a remaining quantity of medicine is approaching zero.

5. The medicine bottle of claim 1, wherein said cap comprises: a flexible strap having opposed ends permanently connected to a bottom edge of said cap and a top edge of said bottle so that said cap is prohibited from being permanently misplaced.

6. The medicine bottle of claim 2, wherein said cap is provided with a plurality of orifices formed along a top surface thereof for allowing an audio signal to emanate outwardly from said transducer and said cap respectively.

7. A medicine bottle for reminding a patient to take a dosage of medicine at a prescribed time, said medicine bottle comprising:

a disposable bottle;

a corresponding disposable cap permanently conjoined to said bottle in such a manner that said cap is selectively adaptable between open and closed positions with respect to said bottle while being prohibited from being displaced more than a maximum distance from said bottle so that said cap is not lost during open positions, said cap having a lock actuator attached thereto and said bottle respectively;

means for recording and playing back instructions to take the medicine dosage at the prescribed time;

means for selectively unlocking said lock actuator from a locked position when a present time is within a predetermined number of hours of the prescribed time;

means for notifying the patient when a remaining quantity of the medicine has fallen below a minimum threshold quantity and a final one of the prescribed time has not occurred; and a user interface displayed on said cap and electrically mated to said recording and playback means, said selectively unlocking means, and said patient notifying means respectively.

8. The medicine bottle of claim 7, wherein said recording and playback means comprises:

an internal power source housed within said cap; and an audio recording and playback device electrically coupled to said power source and mated to said cap respectively;

an amplifier electrically coupled directly to said audio recording and playback device; and a transducer electrically coupled to said amplifier, said amplifier and said transducer being housed within said cap.

9. The medicine bottle of claim 8, wherein said selectively unlocking means comprises:

a logic gate housed within said cap;

a timer electrically coupled to said user interface and said audio recording and playback device, said timer generating a time signal at a preprogrammed interval set by a pharmacist; and wherein said logic gate generates and transmits a true output control signal to said lock actuator upon receiving said audio signal and said time signal within a predetermined time interval;

wherein said logic gate generates and transmits a false output control signal when said time signal is not received within the predetermined time interval after receiving said audio signal;

wherein said true output signal adapts said lock actuator to an unlocked position.

10. The medicine bottle of claim 9, wherein said patient notifying means comprises:

a counter electrically coupled to said logic gate; and an alarm electrically coupled to said timer;

wherein the pharmacists sets said counter at an initial numerical value equal to an initial quantity of the medicine deposited within said bottle, said logic gate further transmitting said true logic output signal to said counter;

wherein said counter subtracts one unit value from the initial numerical value each time one of said true output control signals are received from said logic gate, said counter generating and transmitting an alarm signal to said alarm when the initial quantity of medicine drops below a minimum threshold level such that a user is notified when a remaining quantity of medicine is approaching zero.

11. The medicine bottle of claim 8, wherein said cap comprises: a flexible strap having opposed ends permanently connected to a bottom edge of said cap and a top edge of said bottle so that said cap is prohibited from being permanently misplaced.

12. The medicine bottle of claim 9, wherein said cap is provided with a plurality of orifices formed along a top surface thereof for allowing an audio signal to emanate outwardly from said transducer and said cap respectively.

13. A method for reminding a patient to take a dosage of medicine at a prescribed time, said method comprising the steps of:

a. providing a disposable bottle;

b. providing a corresponding disposable cap permanently conjoined to said bottle in such a manner that said cap is selectively adaptable between open and closed positions with respect to said bottle while being prohibited from being displaced more than a maximum distance from said bottle so that said cap is not lost during open positions;

c. selectively recording and playing back instructions to take the medicine dosage at the prescribed time said cap having a lock actuator attached thereto and said bottle respectively;

d. selectively unlocking said lock actuator from a locked position when a present time is within a predetermined number of hours of the prescribed time; and e. notifying the patient when a remaining quantity of the medicine has fallen below a minimum threshold quantity and a final one of the prescribed time has not occurred.

14. The method of claim 13, wherein step c comprises the steps of:

providing an internal power source housed within said cap; and providing an audio recording and playback device electrically coupled to said power source and mated to said cap respectively;

providing an amplifier electrically coupled directly to said audio recording and playback device; and providing a transducer electrically coupled to said amplifier, said amplifier and said transducer being housed within said cap.

15. The method of claim 14, wherein step d, comprises the steps of:

providing a logic gate housed within said cap;

providing a timer electrically coupled to said user interface and said audio recording and playback device;

said timer generating a time signal at a preprogrammed interval set by a pharmacist;

said logic gate generating and transmitting a true output control signal to said lock actuator upon receiving said audio signal and said time signal within a predetermined time interval to thereby adapt said lock actuator to an unlocked position; and said logic gate generating and transmitting a false output control signal when said time signal is not received within the predetermined time interval after receiving said audio signal.

16. The method of claim 15, wherein step e, comprises the steps of:

providing a counter electrically coupled to said logic gate;

providing an alarm electrically coupled to said timer;

a pharmacist setting said counter at an initial numerical value equal to an initial quantity of the medicine deposited within said bottle;

said logic gate transmitting said true logic output signal to said counter;

said counter subtracting one unit value from the initial numerical value each time one of said true output control signals are received from said logic gate; and said counter generating and transmitting an alarm signal to said alarm when the initial quantity of medicine drops below a minimum threshold level such that a user is notified when a remaining quantity of medicine is approaching zero.

17. The method of claim 13, wherein step b, comprises the step of:

providing a flexible strap having opposed ends permanently connected to a bottom edge of said cap and a top edge of said bottle so that said cap is prohibited from being permanently misplaced.

18. The method of claim 13, wherein step b, further comprises the step of:

forming a plurality of orifices within said cap for allowing an audio signal to emanate outwardly from said transducer and said cap respectively.

* * * * *